US005979817A

United States Patent [19]

Kim

[11] Patent Number: 5,979,817

[45] Date of Patent: Nov. 9, 1999

[54] SYSTEM FOR RECOGNIZING THE POSITION OF SPINNING SPINDLE OF COPS ON A WINDER AND MANAGING ITS DATA, AND METHOD FOR TRACING COP NUMBERS BY CONVEYANCE SECTIONS

[76] Inventor: Kyung-baek Kim, Wangkung Apt. 1-403, 300-11 Ichon-dong, Yongsan-gu, Seoul, Rep. of Korea

[21] Appl. No.: 08/769,992

[22] Filed: Dec. 19, 1996

[30] Foreign Application Priority Data

Feb. 28, 1996 [KR] Rep. of Korea ..... 96-5143

[51] Int. Cl.[6] ..... B65H 54/02

[52] U.S. Cl. ..... 242/474.1; 57/264; 57/281; 242/473.4; 242/473.5; 242/473.6; 242/474; 242/475.2

[58] Field of Search ..... 242/35.5 A, 35.6 E, 242/36, 49, 35.5 R, 473.4, 473.5, 473.6, 474, 474.1, 475.2; 57/281, 264; 198/349.9

[56] References Cited

U.S. PATENT DOCUMENTS

| | | | |
|---|---|---|---|
| 4,554,873 | 11/1985 | Rex | 104/88 |
| 4,730,450 | 3/1988 | Tone | 57/281 |
| 5,269,478 | 12/1993 | Wakabayashi et al. | 242/35.5 A |
| 5,289,983 | 3/1994 | Ueda et al. | 57/264 |
| 5,382,243 | 1/1995 | Jackson et al. | 198/349.9 |
| 5,398,878 | 3/1995 | Mohrke | 242/35.5 A |
| 5,402,951 | 4/1995 | Hermanns et al. | 242/35.5 A |
| 5,497,952 | 3/1996 | Iding | 242/35.5 A |

FOREIGN PATENT DOCUMENTS 3-223072 10/1991 Japan .

*Primary Examiner*—William Stryjewski
*Attorney, Agent, or Firm*—Ladas & Parry

[57] ABSTRACT

A system for obtaining position data of cops on a winder while the cops are carried in a direction along a predetermined conveyance path having sections, connections of sections and sections where movement of the cops in a direction from one of the sections to another of the sections is to be confirmed. Ends of yarn of each of the cops are found in a yarn end feeding portion of the winder. The yarn of the cops is unwound from the cops in a plurality of winding-units of the winder. Remaining yarn on any of the unwound cops is detected in a remaining yarn sensing portion of the winder, and yarnless cops are finally discharged from the winder. Sensors detect only the presence of any one of the cops at respective sensor positions along the predetermined conveyance path. The sensor positions are by the connections of sections of the predetermined conveyance path and the sections where movement of the cops in the direction from one of the sections to another of the sections is to be confirmed for obtaining the position data of each of the cops along the predetermined conveyance path.

9 Claims, 10 Drawing Sheets

FIG. 7

| COP NUMBER | NUMBER OF LOSING END OF YARN | WINDING UNIT NUMBER PASSING FIRST | REMAINING YARN | NUMBER OF CUTTING YARN | FALSE OPERATION |
|---|---|---|---|---|---|
| 0001 | 0 | 1 | 0 | 8 | 0 |
| 0002 | 3 | 5 | 1 | 1 | 0 |
| . | . | . | . | . | . |
| . | . | . | . | . | . |
| 0999 | 0 | 18 | 1 | 10 | 1 |
| 1000 | 1 | 30 | 0 | 0 | 0 |

FIG. 8

| WINDING UNIT NUMBER | COP NUMBER | NUMBER OF CUTTING | FALSE OPERATION |
|---|---|---|---|
| 01 | 1 | 8 | 0 |
| | 105 | 7 | 0 |
| | 208 | 10 | 0 |
| | | | |
| | ⋮ | ⋮ | ⋮ |
| | | | |
| 02 | 5 | 1 | 0 |
| | 99 | 0 | 1 |
| | 107 | 0 | 0 |
| | | | |
| | ⋮ | ⋮ | ⋮ |
| | | | |
| | ⋮ | ⋮ | ⋮ |

SYSTEM FOR RECOGNIZING THE POSITION OF SPINNING SPINDLE OF COPS ON A WINDER AND MANAGING ITS DATA, AND METHOD FOR TRACING COP NUMBERS BY CONVEYANCE SECTIONS

BACKGROUND OF THE INVENTION

The present invention relates to a spinning machine-linked winder, and more particularly, to a system for recognizing the position of spinning spindle of cops on a winder and managing its data, and a method for tracing cop numbers by conveyance sections, in which the number of cop located in the divided conveyance sections is identified, and data by cops is analyzed to effectively manage the spinning spindle's problem, the winder drum's problem, and the winder's inefficiency caused by losing the end of the yarn or due to remaining yarn inside the winder.

Yarn is made of natural or synthetic fibers through opening/blowing, carding, combing, drawing, roving, spinning, winding, plying and twisting. Here, spinning is a procedure of drafting and twisting filaments after roving in order to obtain a final yarn of a predetermined strength, thickness, and elasticity. Winding is a procedure of winding the yarn produced during spinning in the commercial form of cone, and at the same time, removing ununiform, that is, thicker or thinner, yarns. The yarn made by the spinning machine is wound around a wood bobbin. The wood bobbin with the yarn is called a cop (and, herein, continues to be called a cop after the yarn is unwound from the bobbin in a winder; i.e., a yarnless bobbin discharged at section K in FIG. 5 described below is still called cop). This cop is carried to the winder through a link system to automatically connect the spinning machine and the winder so as to be wound in the form of a cone.

FIG. 1 shows a system containing conventional spinning machine 2 and winder 4, where cops 6 are loaded on tray 8 (shown in FIG. 2) and carried to winder 4 from spinning machine 2 through link system 10. Spinning machine 2 consists of 400, 432, 960, 1024 spindles (not shown). Wound cops 6 are produced from the respective spindles. The empty bobbins for cops 6 are carried by the same number of trays 8 as that of the spindles and supplied by a doffing device (not shown). The cop 6 with the yarn is loaded on the tray 8 by the doffing device.

The cop 6 loaded on tray 8 is then carried to winder 4 from spinning machine 2, and winder 4 loads cop 6 on tray 8 and transports it to the plural winding units 12. The yarn is wound around a paper bobbin in a drum (not shown) placed above winding units 12, so as to make cone 14. Here, depending on the equipment, the tray of spinning machine 2 and the tray of winder 4 may operate separately, or the tray of spinning machine 2 may be carried to winder 4 with cop 6.

Sometimes spinning machine 2 and winder 4 falsely operate due to poor equipment, inaccurate setting conditions, poor quality of half-finished goods transported from the preceding process, or the operator's mistakes. Their specific examples include frequent yarn cuttings in the spinning machine or winder, losing the end of yarn in the winder, lack of weight of the yarn wound around the cop, or frequent operation troubles in a specific portion of the winder. In order to detect and solve those states, an apparatus for monitoring spinning or winding state of the spinning machine or winder was developed. However, the conventional equipment requires extreme installation cost, and an expensive apparatus must be installed in the spinning machine and winder to increase the installation cost as well as maintenance cost. As a result, this greatly affects production cost. Especially, despite its efficiency, the monitoring apparatus installed in the spinning machine is limited in its usage because of an excessive investment cost resulting from a sensor that recognizes the state of the apparatus, development in sensing mode, and a large number of spindles.

An automatic doffing device is essentially mounted as the vital device in the spinning machine. In order to utilize it economically, the number of spindles of spinning machine per unit is being increased over 1,000. For this reason, it is not easy to find bad spindles among so many spindles, but this process becomes essential in terms of quality improvement as well as production. Even one bad quality makes a cone regarded as bad quality because 20–30 cops must be joined in order to produce one cone. Therefore, it becomes so important to find out the running situation of each spindle of the spinning machine and where the bad quality cop comes from, to the extent similar to the effect of monitoring directly in the spinning machine, after gathering yarn end data, quality/production data, and remaining yarn data in the winder.

A monitoring apparatus automated to overcome such task is disclosed in a Japanese Laid-open Patent Publication No. Hei3-223072 entitled "Method for writing and reading identification data of spinning bobbin". This apparatus needs a separate device for reading the respective bobbins' recognition sign in order to trace the position of a cop, and a separate recognition device that inserts bar codes to the tray, attaches recognition material such as magnetic film, and deformed bobbins. This hinders its general application to the existing spinning machine and winder.

SUMMARY OF THE INVENTION

It is an object of the present invention to provide a system for recognizing the position of spinning spindle of cops on a winder, and managing its data, in which specific numbers are provided to cops along the conveyance path, using a program of simulating the connection state of the spinning machine and winder and a sensor for general recognition requiring no special tray or additional reading device.

It is another object of the present invention to provide a system for recognizing the position of spinning spindle of cops on a winder, and managing its data, in which data such as the number of remaining yarn, the number of finding the end of yarn, quality/production, and yarn cutting, is obtained with the cone numbers (the number of the position of spinning spindle produced and the number of the winding unit winding the cone), and the data is used as management data.

It is still another object of the present invention to provide a system for recognizing the position of spinning spindle of cops on a winder, and managing its data, in which the installation state of the spinning machine and winder is integrally managed with the winding state of the cops.

It is yet another object of the present invention to provide a method for tracing cop numbers by conveyance sections of cops on a winder, in which the conveyance path of the winder is divided into multiple sections, cop numbers are registered and erased by the divided sections, the cop numbers are managed in conjunction with data such as the number of times finding the end of yarn, the number of times of remaining yarn, and false operation status in order to detect the absence or presence of poor cop or winding unit, and the position of cop is traced on the spinning machine.

To accomplish the objects of the present invention, there is provided a system for recognizing the position of spinning spindle of cops on a winder, and managing its data, the system being made in such a manner that cops are carried to the winder from a spinning machine via a link system, the cops are carried through a predetermined conveyance path from the winder, the end of yarn is found in a yarn end feeding portion, the cops are wound in a plurality of winding units, remaining yarn is detected in a remaining yarn sensing portion, and the cops are finally discharged, the system comprising: sensing means for forming the connection state of the spinning machine and winder in a simulation program, the means sensing cops installed at necessary positions by sections which include a portion where the connection of sections can be indicated and a portion where the movement of cops from one section to another can be confirmed; control means for controlling the conveyance of the cops along the conveyance path, the control means providing a number to the cop initially entering the conveyance path according to a sensing signal to register the number to the current position, the control means transfer-registering the cop numbers to the current position, the means storing the data by cop numbers and winding units; and output means for monitoring the stored data by cop numbers and winding units, and outputting it.

The conveyance path is made in the combination of a diverging structure where the cops selectively advance to two diverging sections from one section, a joint structure where the cops are gathered into one section from two different sections, and an extension structure where the cops are carried from a section to another at a reference of one dividing point, wherein first and second sensors are installed at a predetermined position after a diverging point of the diverging structure, third and fourth sensors are installed at predetermined positions of a section prior to a joint of the joint structure, and a fifth sensor is installed at the dividing point of the extension structure, and the control means transfer-registers cop numbers to a section after conveyance from a section prior to conveyance when the cops are sensed by the first–fifth sensors.

The conveyance path is divided into a section A where the cops are introduced, a section B for finding the end of yarn, a section C for feeding the end of yarn, a section D for refinding the end of yarn, sections E1–E30 where the cops are conveyed to the respective winding units, a section F where the cops are fed back for re-entrance after the failure of entrance to the respective winding units, sections G1–G30 where the cops are entered by the winding units, the respective winding unit sections, sections H1–H30 where the cops are discharged from the winding units, sections I1–I30 where the cops are carried to be discharged between the respective winding units, a section L where the cops having remaining yarn are fed back, and a section K for discharging cops from the winder.

The control means accumulates the number of losing the end of yarn and the number of remaining yarn when a specific cop goes into the sections D and L, the means storing the accumulated data in connection with a corresponding cop number.

For the objects of the present invention, there is further provided a method for tracing cop numbers by conveyance sections on a winder wherein as many cops as spindles sequentially carried from a spinning machine are discharged via plural sections divided by plural sensors, the winder comprising, along a conveyance line, a yarn end feeding portion for finding the end of yarn of the cops, a plurality of winding units for winding the yarn of cops around a cone, and a remaining yarn sensing portion for detecting whether there is yarn remaining, the method forming the connection state of spinning and winding, the method comprising the steps of: (a) scanning sensing signals of the sensors, allocating cop numbers to cops entering the conveyance line, and registering the numbers to the initial entrance section of the plural sections; (b) scanning the sensing signals, and transfer-registering the cop numbers to a following position if a specific cop is determined to enter one section from another; and (c) scanning the sensing signals, and erasing a corresponding cop number if a specific cop is determined to be discharged from the conveyance path.

After the steps (1), (2) and (3), there is further provided the step of storing information input from the yarn end feeding portion, winding unit, and remaining yarn sensing portion in connection with the cop numbers.

The step (2) further comprises the step of incrementing and recording the number of losing the end of yarn with respect to a corresponding cop number if the current transfer-registered position of the specific cop is in the section D where the cop is carried to find the end of yarn.

The step (2) further comprises the step of incrementing and recording the number of remaining yarn with respect to a corresponding cop number if the current transfer-registered position of the specific cop is in the section L where the remaining yarn is confirmed and then the cop is fed back.

BRIEF DESCRIPTION OF THE ATTACHED DRAWINGS

FIG. 7 shows a list of data by cops;

FIG. 8 shows a list of data by winding units;

DETAILED DESCRIPTION OF PREFERRED EMBODIMENT

The present invention is conceived in terms of three points in implementing its embodiment. First, numbers for respective cops can be automatically offered with software so that the positions of spindles are confirmed in a spinning machine by cops when they come out of the spinning machine after doping and are then introduced into a winder. The cop numbers are offered and managed with software so that the cops entering the winder from multiple spinning machines are sensed by a sensor and the respective cops sensed are discriminated with other cops inside the winder. The position of a specific cop along the conveying path can be confirmed with software, referring to the sensor's sensing number. The cop numbers can be managed in conjunction with data on the number of losing yarn end, the number of winding unit passed, presence or absence of remaining yarn, the number of yarn cut, and false operation. The data can be counted with the shift position of cop or input by a peripheral device such as winding unit.

Figure 1:
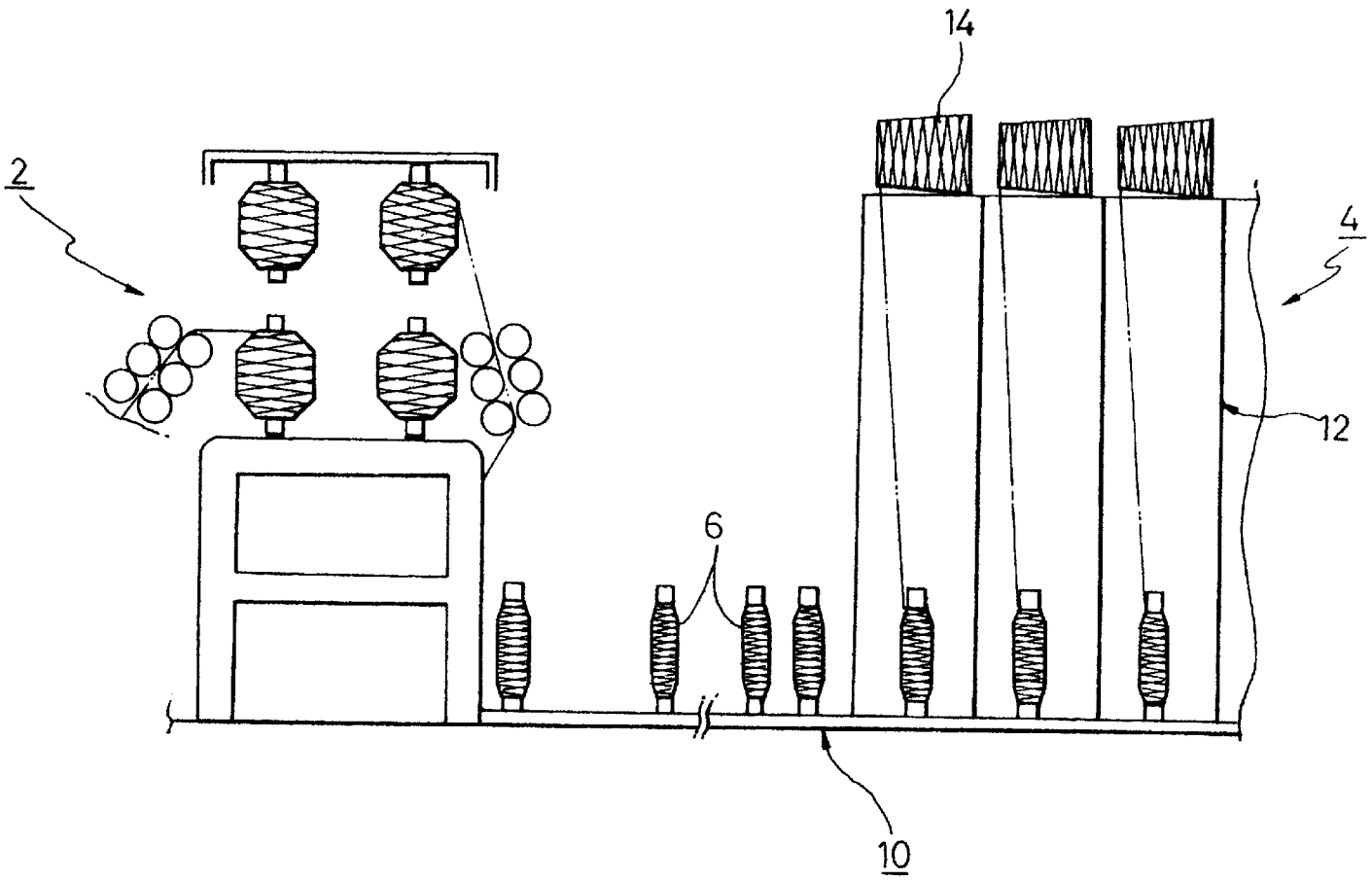
FIG. 1 (PRIOR ART)
FIG. 1 is a diagram of a system for carrying cops from a conventional spinning machine to a winder during spinning procedure.
Figure 2A:
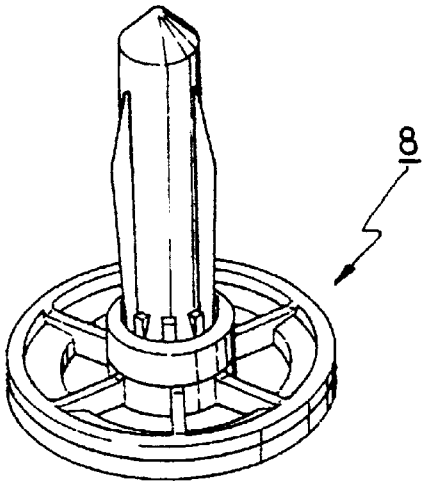
FIG. 2A is a perspective view of a cop carrying tray.
Figure 2B:
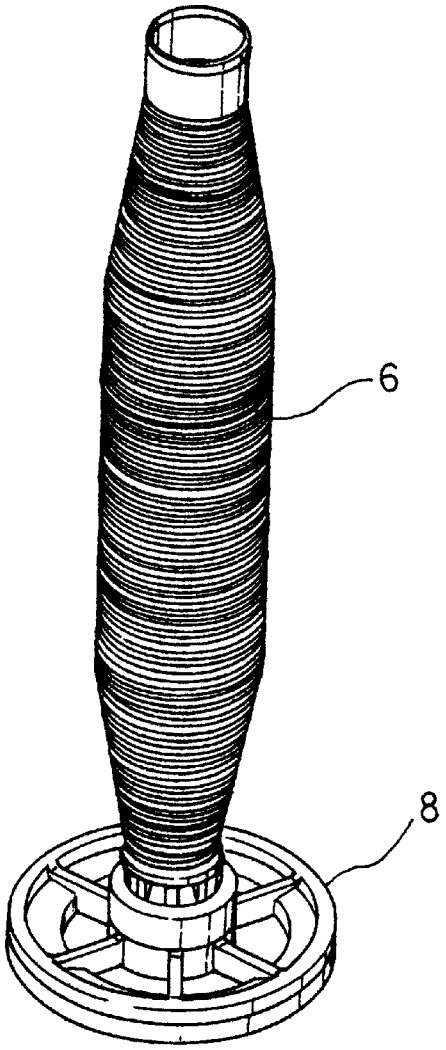
FIG. 2B is a perspective view of a state in which the cop is mounted on the tray.
Figure 3A:
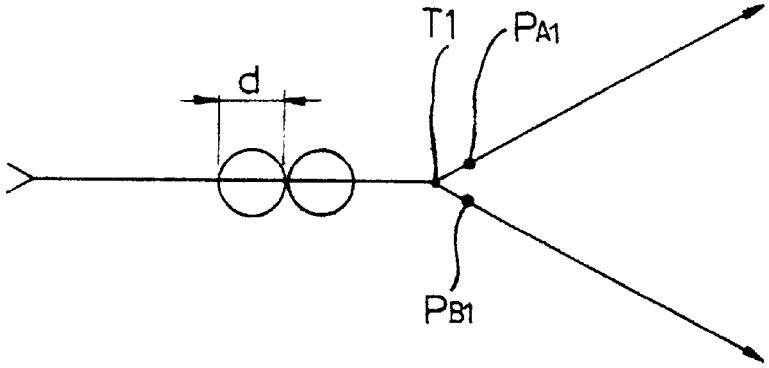
FIGS. 3A, 3B and 3C are diagrams for explaining the points of the present invention.
Figure 3B:
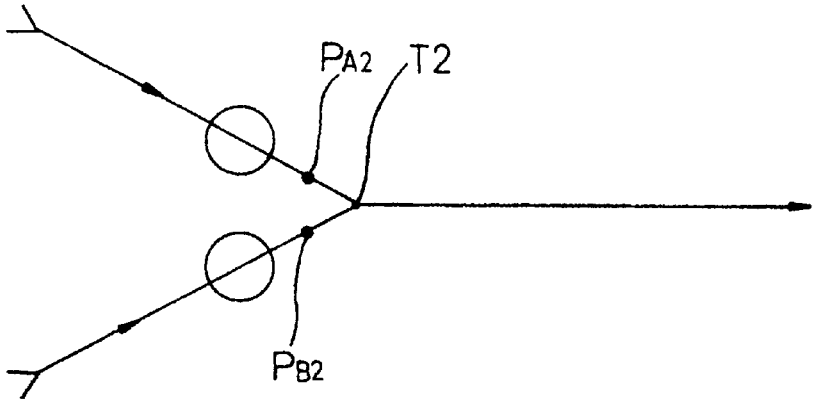
Figure 3C:
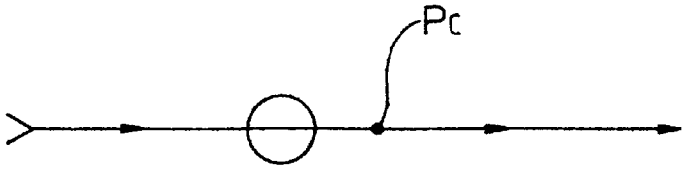

Secondly, the conveying path from the winder where the cop having a specific number is located can be divided into multiple sections. These sections may be connected as shown in FIGS. 3A, 3B and 3C. There are three combinations of the conveyance path such as 1:2 connection in which the conveying path is divided into two as shown in FIG. 3A, 2:1 connection in which the path is joined into one from two as shown in FIG. 3B, and 1:1 connection in which the path is continuously connected. Specific points of the method for sensing conveyance to the following sections of the cop in the combinations of FIGS. 3A, 3B and 3C are described.

As shown in FIG. 3A, in the 1:2 connection, sensors $P_{A1}$, and $P_{B1}$ for detecting the movement of cops are installed in the two sections branched off from diverging point T1. If the number of cop placed in a section prior to diverging point T1 is 10, 11, 12, . . . , the sequence of cops carried to the respective branched sections via diverging point T1 is 10, 11, 12, . . . . Here, the cops are carried to one section selected between the two branched sections so that there is a need to sense which cop is conveyed to which section. This can be solved in the following method.

Given that the distances of sensor $P_{A1}$, and of sensor $P_{B1}$from diverging point T1 be d11 and d12, times t11 and t12 to reach sensors $P_{A1}$, and $P_{B1}$ from diverging point T1 become d11/v11 and d12/v12, respectively. Here, v11 and v12 are cops carrying speed in the two branched sections. Suppose that the minimum distance between preceding and following cops in the section prior to diverging point T1 is d (the minimum distance is equal to the diameter of the tray), conveyance time t01 with respect to distance d becomes d/v01. Here, v01 is the conveyance speed in the section prior to diverging point T1.

If value |t11−t12| is smaller than t01, this means that the cop placed in the section prior to diverging point T1 is carried to the section where the sensor first generating a sensing signal is placed. This enables the cop number first registered in the section prior to diverging point T1 to be transfer-registered to the section where the sensing signal is generated. Here, the position of sensor is set in a corresponding section in consideration with the conveyance speed and the interval of cop in the respective sections. Preferably, the position of sensor is set so that t11=t12 and t01>t11, t12 in order to obtain the most accurate sensing signal.

As shown in FIG. 3B, in the 2:1 connection, sensors $P_{A2}$ and $P_{B2}$ are installed in the two sections prior to joint T2, contrary to the 1:2 connection. Given that the distances from sensors $P_{A2}$ and $P_{B2}$ to joint T2 in the two sections prior to joint T2 be d21 and d22, respectively, and conveyance speeds on the respective paths be v21 and v22, conveyance times t21 and t22 become d21/v21 and d22/v22, respectively. If sensors $P_{A2}$ and $P_{B2}$ are installed so that the cop carrying times to joint T2 by the sections become equal (t21=t22), the first cop number of the section where the sensor first generating the sensing signal is located is transfer-registered to the section after joint T2. As shown in FIG. 3C, in the 1:1 connection, if the sensing signal is input from sensor $P_c$ the first cop number of the section prior to sensor $P_c$ can be transfer-registered to the section after sensor $P_c$ Meanwhile, thirdly, the spinning machine and winder are connected with a link system so that this invention can be easily applied to a general system in which the cops by spindles of the spinning machine are sequentially moved to the winder for winding. In addition, the complex connection state of the spinning machine and winder is set with a simulation program and can be corrected. Furthermore, appropriate modification can be made possible when the spinning machine and winder are changed in its configuration, capacity and size according to manufacturers.

Figure 4:
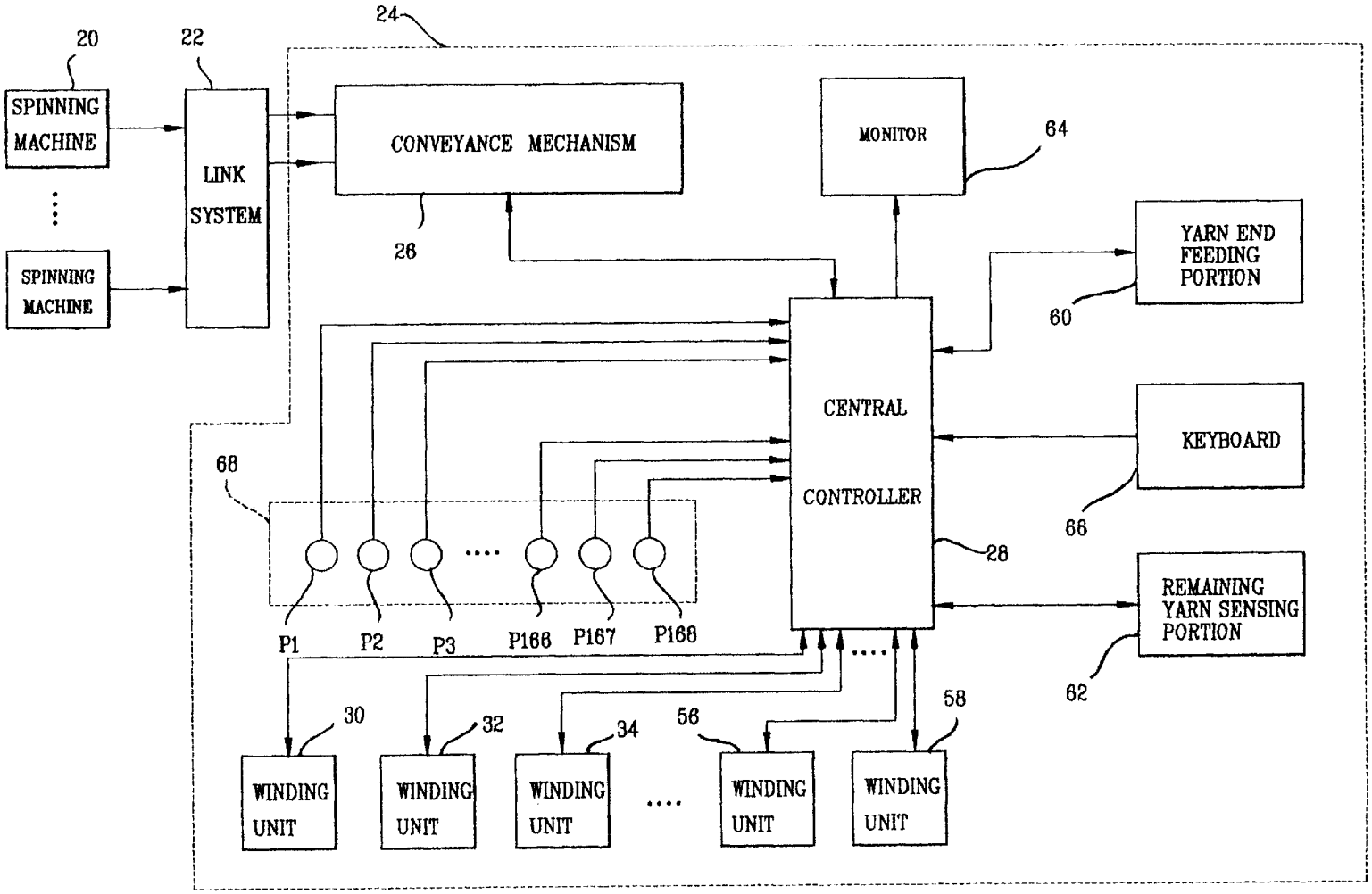
FIG. 4 is a block diagram of one embodiment of a system for recognizing the spindle position of cops on a winder, and managing its data according to the present invention.
Figure 5:
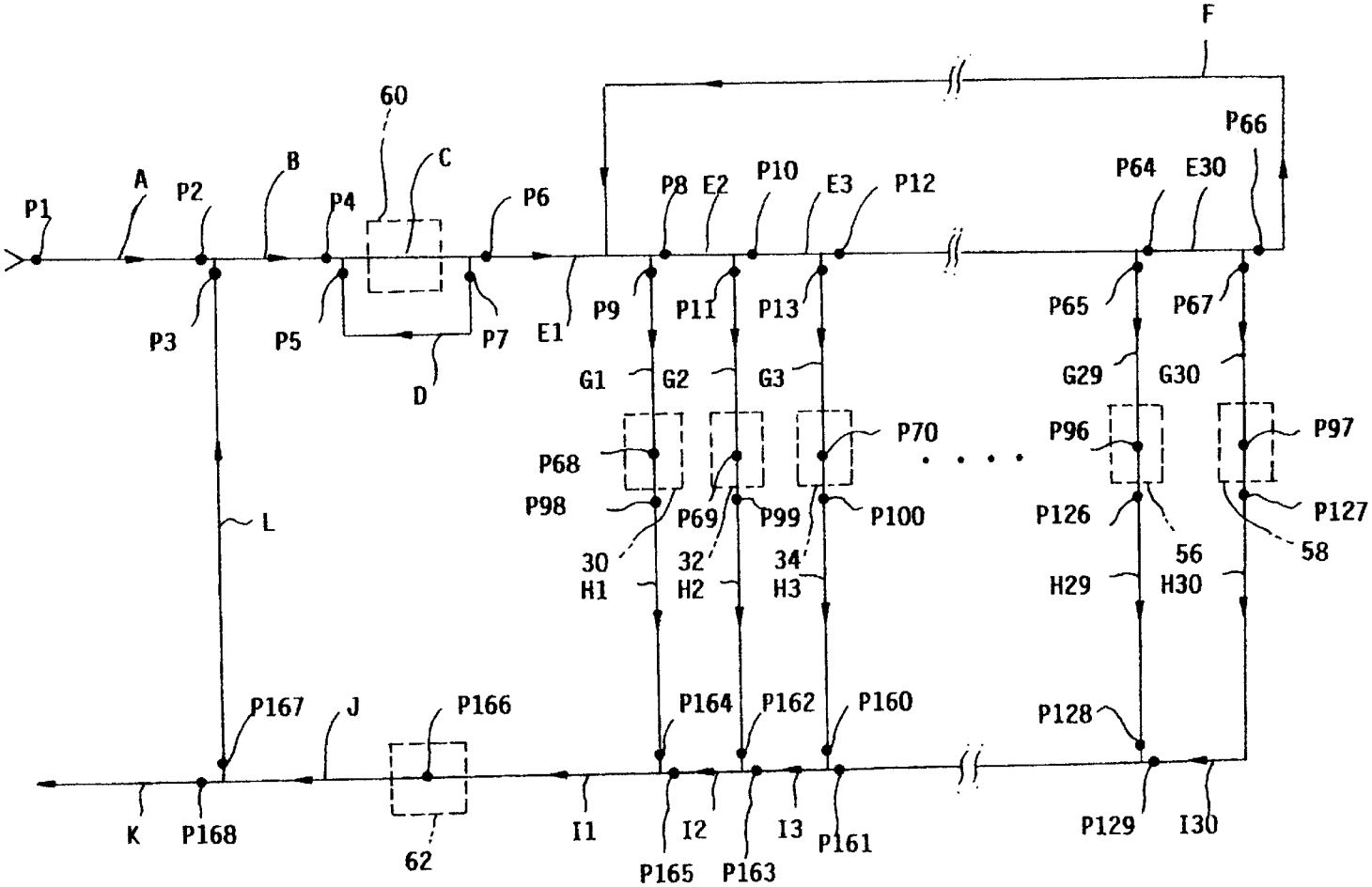
FIG. 5 shows a cop conveyance path, sensors along the path, and respective component dispositions according to the conveyance mechanism of the present invention.

One embodiment of the present invention with the above points is constructed as shown in FIG. 4, and the conveyance path and the disposition of the respective components in the conveyance mechanism are made as shown in FIG. 5.

In this embodiment, the cops are loaded on trays and carried to winder 24 via link system 22 from spinning machine 20, along the conveyance path of FIG. 5 in the conveyance mechanism 26 of winder 24. To conveyance mechanism 26 of winder 24, a central controller 28 is connected to control the cop conveyance in the direction of arrow indicated along the conveyance path of FIG. 5. A plurality of drum assemblies 30–58 disposed as shown in FIG. 5 and central controller 28 for controlling them are constructed to exchange an operation control signal for winding units 30–58 and data on yarn cutting and false operation caused in winding units 30–58. Yarn end feeding portion 60 for finding the end of yarn of the cops and remaining yarn detector 62 for detecting remaining yarn are connected in parallel so as to exchange the control signal and corresponding specific data with central controller 28. As an output device for outputting information such as data by cops or data by winding units, monitor 64 is connected to central controller 28. A printer may be further connected as the output device, and a keyboard 66 is connected to input the operator's command to central controller 28.

A sensor portion 68 is connected to central controller 32, and made up with a plurality of sensors P1–P168 disposed at the respective portions of the conveyance path, in order to sense the movement of cops. Here, sensors P1–P168 are disposed on basis of the points of the present invention explained in the description of FIGS. 3A, 3B and 3C so that it is sensed for the cops to pass specific positions along the conveyance line. The sensors are usual contactless sensors which may be implemented with photosensors, ultrasonic sensors, or on/off switches.

In this embodiment of the present invention, the conveyance section is divided in plurality. At a portion where the cops are initially entered, a sensor p1 made to sense the conveyance of cops and provide cop numbers thereto is installed. At the diverging points and joint, sensors P2–P168 are installed to sense the conveyance of cops in order to transfer-register the cop numbers. The position or number of the sensors may be changed according to the contents of information required or the number of winding units.

Specifically, the conveyance section is divided into section A where the cops are introduced, a section B for finding the end of yarn, a section C for feeding the end of yarn, a section D for refinding the end of yarn, sections E1–E30 where the cops are conveyed to the respective winding units, a section F where the cops are fed back for re-entrance after the failure of entrance to the respective winding units, sections G1–G30 where the cops are entered by the winding units, the respective winding unit sections, sections H1–H30 where the cops are discharged from the winding units, sections I1–I30 where the cops are carried to be discharged between the respective winding units, a section L where the cops having remaining yarn are fed back, and a section K for discharging cops from the winder.

Central controller 28 offers codes like A–L by the divided sections, and software is set to transfer-register the number of cop located by the sections when its movement is sensed. This software is made so that data can be gathered by the cop numbers or winding unit numbers. The operation and effect of the embodiment constructed as above will be explained below.

The new registration, transfer-registration and erasure of cop numbers are made as in the description of FIGS. 3A, 3B and 3C. The specific operations of the embodiment will be described with the reference of the order where the cops pass.

When the cops are conveyed to winder 24 from spinning machine 20 via link system 22 along the conveyance path, introduced to the conveyance path of winder 24, and sensed by sensor P1, a specific number is provided to a cop, and its current position is newly registered as section A. When the cop is continuously carried from section A and sensed by sensor P2, the cop number is transfer-registered from section A to section B. Here, to section B, the cop numbers of sections A and L are transfer-registered by sensors P2 and P3.

When the cops are sensed by sensor P4 in section B, the cop number is transfer-registered to section C, and the cop enters yarn end feeding portion 60. Then, yarn end feeding portion 60 finds and feeds the end of yarn. Winding yarn around the cop in winding units 30–58 can be performed when the end of yarn must be found here.

If the end of yarn is found in yarn end feeding portion 60, the cop advances and is sensed by sensor P6 to be transfer-registered to section E1 from section C. If not, the cop is carried to section D in order to re-find the end of yarn, and the cop number is transfer-registered to section D from section C as sensor P7 senses it. The cop carried to section D is re-carried to yarn end feeding portion 60, and when the cop is sensed by sensor P5, the cop number is retransfer-registered to section C from section D.

The cop entering section E1 is continuously carried to sections E2-E30, and tries the entrance by winding units 3058. Here, through sections E1–E30, the cop is sensed by sensors P8, P10, P12, . . . , P64, and the cop number is transfer-registered to sections E2–E30. The cops entered by winding units 30–58 are sensed by sensors P9, P11, P13, . . . , P67, and the cop numbers are transfer-registered to sections G1–G30 from sections E1–E30. If the cops cannot enter winding unit 58 in section E30, they are carried to section F and fed back to try reentrance from winding unit 58. Thus the cop number is transfer-registered to section F from section E30.

When the cops continuously advance in sections G1–G30 and are located in winding units 30–58 disposed on corresponding lines, the cops are sensed by sensors P68–P97, and the cop numbers are transfer-registered to winding units 30–58. Through the above procedure the cops placed in corresponding winding units are wound with yarn. The yarn wound around the cop is guided by a drum and wound around a cone located above winding units 30–58.

The cops are discharged after the completion of winding yarn, which are sensed by sensors P98–P127. If so, the cop numbers registered to winding units 30–58 are transfer-registered to sections H1–H30. If the cops continuously carried from sections H1–H30 are sensed by sensors P128, . . . , P160, P162, and P164, the cop numbers are transfer-registered to sections I1–I30 connected with sections H1–H30. The cops are continuously moved to remaining yarn sensing portion 62, and section transfer-registration is kept in accordance with the conveyance from section I30 to section I1.

If the cops are located in section I1, they go into remaining yarn sensing portion 62 to detect the absence or presence of remaining yarn, and then are discharged. Here, the conveyance of the cops is sensed by sensor P166 so that the cop numbers are transfer-registered to section J from section I1. If the cops are continuously carried from section J and there is no remaining yarn according to the result sensed by remaining yarn sensing portion 62, the cops are moved to section K to be discharged out of winder 24. If there is yarn remaining, the cops are fed back to section L in order to wind the yarn remaining. The cop numbers are transfer-registered to section K or section J from section J. If the cop number is transfer-registered to section K, it is erased.

Figure 6:
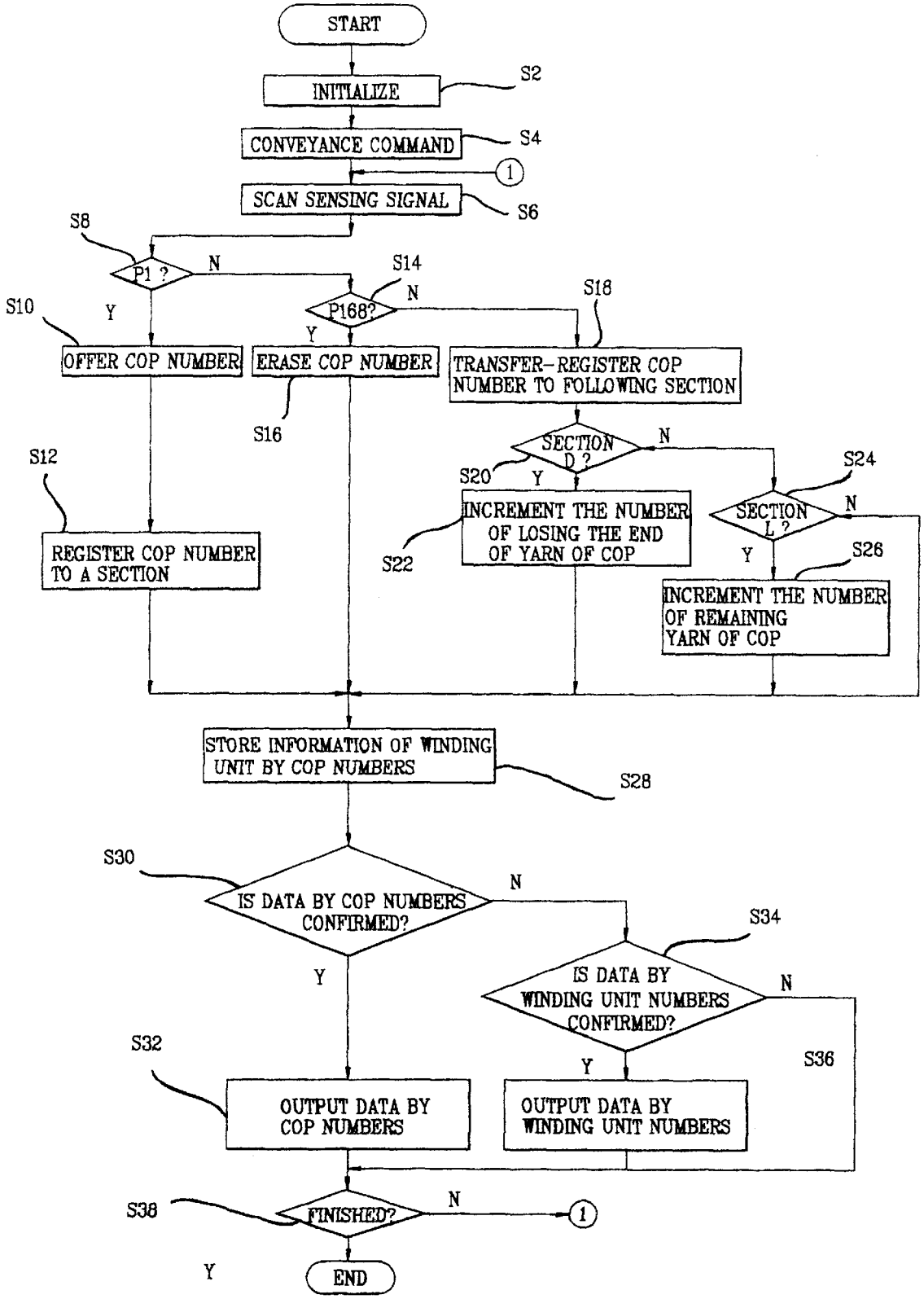
FIG. 6 is a flowchart showing one embodiment of a method of tracing cop numbers by conveyance sections on the winder according to the present invention.

While the cop numbers are provided and transfer-registered by sections along the conveyance path, data by cop numbers and winding units are managed by central controller 28. The management of data by cop numbers and winding units will be explained with reference to FIG. 6.

When an operation start command is input via keyboard 66 by the operator, central controller 28 performs step S2 and initializes the respective components of winder 24. The operator inputs a spinning machine operation command together with the winder's operation start command. After step S2, central controller 28 performs step S4, and outputs a conveyance command to conveyance mechanism 26 to carry the cops. When the cops are carried in step S4, it is scanned whether the sensing signal is input from sensors P1–P168.

If the sensing signal is input from any sensor while the sensing signal is scanned in step S6, central controller 28 decides whether it is the input of sensing signal from sensor P1 in step S8, and if so, step S10 is performed to decide that the cop is introduced first. Then, its cop number is provided, and step S12 is performed to register it to section A.

If the sensing signal is input from sensor P168, central controller 28 decides that the cops are located in section K in order to discharge the cops having no remaining yarn after the winding procedure in winder 24, and performs steps S8, S14, and S16 in order to erase the cop number. If it is decided that the sensing signal is not input from sensors P1 and P168, central controller 28 decides that the sensing signal is input from sensors P2–P167, and performs step S18 so that the cop number registered to the current section is transferred to the following section and step S20 is then performed.

In step S20, if it is decided that the input sensing signal is from sensor P7 and the cop number is transfer-registered to section D, central controller 28 performs step S22 and increases the number of losing the end of yarn with respect to the current cop number. If not, central controller 28 performs step S24 and confirms whether the current cop number is registered to section L. If so, step S26 is performed to increase the number of yarn remaining for the corresponding cop number.

Central controller 28 performs steps S12, S16, S22, S26, and S28 so that information input from winding units 30–58 is matched to cop numbers and then stored. Steps S30 and S34 are performed to confirm whether the operator wants the output of the data stored.

If it is determined in step S30 that the confirmation of data by cop numbers is requested, central controller 28 performs step S32 and outputs data by cop numbers. If it is determined in step S34 that the confirmation of data by winding units is requested, central controller 28 performs step S36 and outputs data by winding units. If steps S32 and S36 are performed to output data or data output is not performed in step S34, central controller 28 performs step S38 to confirm whether the key signal for ending yarn winding is input from keyboard 66. If it is not the operation end, step S6 is reperformed, and if it is the operation end, the operation of the winder stops.

During winding the state of yarn is monitored by a yarn clearer (not shown), and its defects are removed by the cutter of the yarn clearer. Here, several kinds of data such as the number of cutting yarn, the state of quality, weight of cops, and the number of piercing are checked with respect to the cop winding yarn in the winding unit. They are classified by central controller 28 as shown in FIG. 7 in connection with information by cops.

As shown in FIG. 7, the number of finding the end of yarn is incremented by 1 when the cop number is registered to section D where the end of yarn is not found and the cop returns. The winding unit number passing first is provided when the cop is sensed by sensors P68–P97. The data on remaining yarn is incremented by 1 when the cop number is transfer-registered to section L. The data on the number of cutting yarn and false operation are input to the central controller from the winding units and stored in conjunction with cop numbers.

In this embodiment of the present invention the problem of cop or the problem of winding unit passed by the cops is statistically supported. The number of cop where yarn cutting happens frequently is confirmed to find out the position of the cop in the corresponding spinning machine. The data classified by winding units is as shown in FIG. 8. According to this, a winding unit such as winding unit number 01 where yarn cutting or false operation is caused frequently can be confirmed. A trouble winding unit can be examined and analyzed by gathering and analyzing data on abnormal cops in the above manner. Besides yarn end feeding portion 60 must be reexamined when the number of losing the end of yarn is large as a whole. If multiple sensors are further installed along the conveyance path to the winder from the plural spinning machines via the link system, the spinning machines can also be classified by the sensing signal.

Meanwhile, the position of the respective cops can be precisely confirmed and managed by adding an error detecting sensor for auxiliarly sensing the conveyance of cops at the diverging point and joint of the paths in preparation for the trouble of the sensors provided at the respective portions. For this, sensors $P_{D1}$ and $P_{D2}$ are installed before and after the diverging point and joint, as shown in FIGS. 9A and 9B.

Figure 9A:
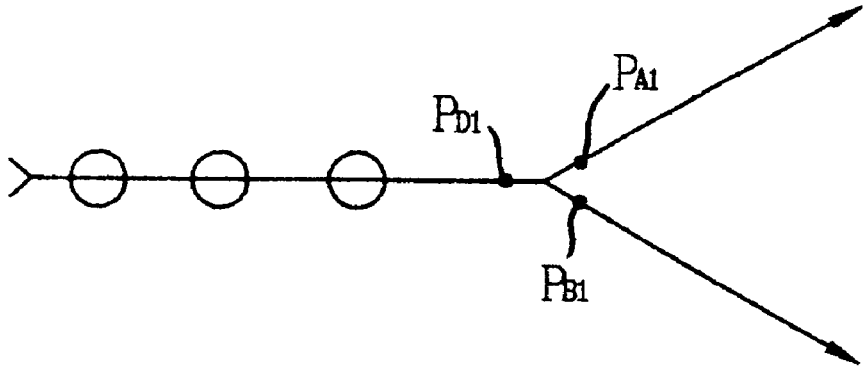
FIGS. 9A and 9B are the drawings showing that sensors for detecting errors are added to a diverging structure and a joint structure, respectively.

Referring to FIG. 9A, a cop having a specific number and carried to the diverging point along the conveyance path is sensed first by sensor $P_{D1}$, and then by one of sensors $P_{A1}$, and $P_{B1}$ after the diverging point. The central controller transfer-registers the cop to the section after sensor $P_{A1}$ or $P_{B1}$ according to whether the cop sensed by sensor $P_{D1}$ is sensed by sensor $P_{A1}$ or $P_{B1}$.

Figure 9B:
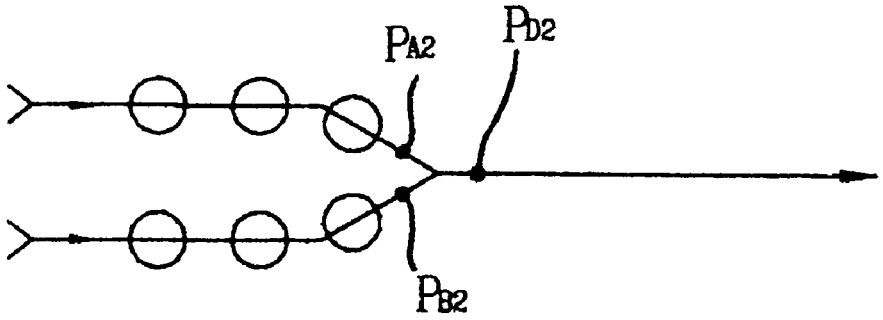
Figure 10:
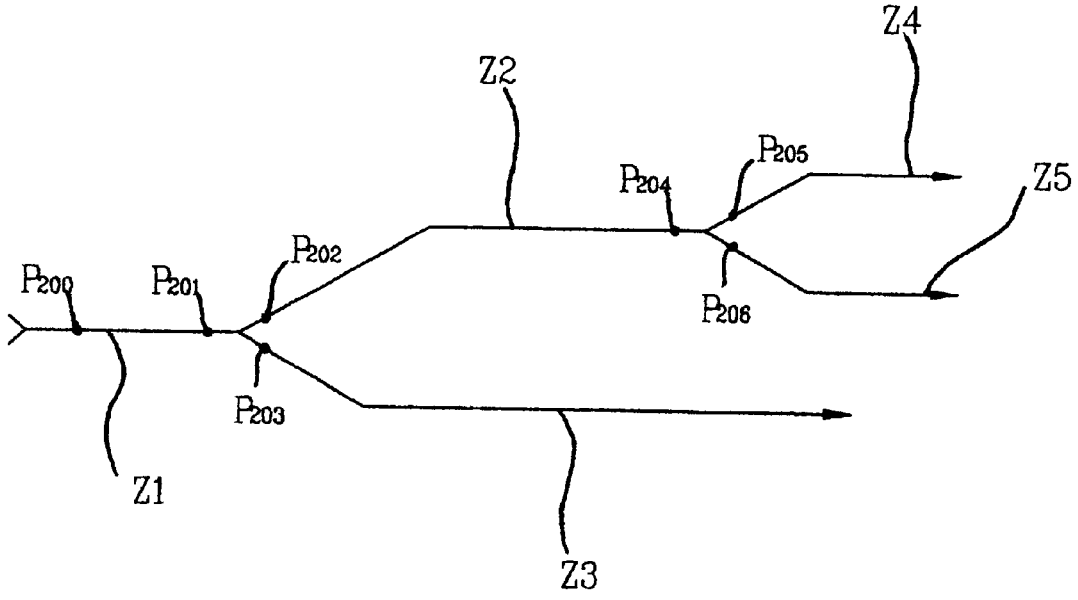
FIG. 10 shows a cop conveyance path in which sensors for detecting errors are provided further.

Likewise, referring to FIG. 9B, a cop having a specific number and carried to the joint is sensed by sensor $P_{A2}$ or $P_{B2}$ by paths and then by sensor $P_{D2}$ installed after the joint so that the cop is transfer-registered to the section after sensor $P_{B2}$. FIG. 10 shows an example in which the error detecting sensors of FIGS. 9A and 9B are installed.

Referring to FIG. 10, there will be explained the operation of transfer-registration and error-detection for cops sensed by sensor $P_{200}$ and registered to section Z1. In FIG. 10, the path is diverged at section Z1, and sections Z2 and Z3 are connected thereto. Sections Z4 and Z5 are connected to section Z2 which is diverged. At the beginning of section Z1, sensor $P_{200}$ is installed, and prior to the diverging point of section Z1, sensor $P_{201}$ is provided. After the diverging point, sensors $P_{202}$ and $P_{203}$ are installed. Near to the diverging point where sections Z4 and Z5 are diverged from section Z2, sensors $P_{204}$–$P_{206}$ are installed.

The cop enters section Z1 and continues to be carried via sensor $P_{200}$ and sensor $P_{201}$. When the cop advances to one of sections Z2 and Z3 after sensor $P_{201}$, it is sensed by one of sensors $P_{202}$ and $P_{203}$. When the cop located in section Z1 advances to be sensed by sensors $P_{201}$ and $P_{202}$, it is transfer-registered to section Z2. If the cop is sensed by sensors $P_{201}$ and $P_{203}$, it is transfer-registered to section Z3.

If the cop is sensed by sensor $P_{202}$ or $P_{203}$ but not by sensor $P_{201}$, or by sensor $P_{201}$ but not by sensor $P_{202}$ or $P_{203}$, this indicates that there occurs an error in the system. In this case the cop stops immediately and the cop transferring data can be corrected by soft wear program. Therefore, this enables the conveyance of cop by sections to be managed precisely, and if a sensor error happens, this situation can be confirmed immediately and the exact tracing data can be offered by soft wear program or operator.

According to the present invention the position of cops carried inside the winder can be confirmed, and data can be managed by cops so that portions which cannot be confirmed by a conventional system are efficiently managed. In addition, the equipment trouble can be traced by integrally managing the states of winder and spinning machine and classifying poor cops so that the maintenance of equipment is performed accurately and easily.

Further, the cops can be recognized with software according to the same concept as a general system without change of structural modification of tray, so that peripheral equipment becomes unnecessary and economical burden is minimized. The flow of goods inside the winder can be recognized precisely and important information is made in the form of materials in connection with external data. This enables the complex system to be established.

Although the present invention has been described above with reference to the preferred embodiments thereof, those skilled in the art will readily appreciate that various modifications and substitutions can be made thereto without departing from the spirit and scope of the invention as set forth in the appended claims.

What is claimed is:

1. In a system for obtaining position data of cops without using any special recognition material thereon on a winder while the cops are carried in a direction along a predetermined conveyance path including (a) sections, (b) connections of predetermined ones of the sections and (c) first and second predetermined ones of the sections where movement of the cops in a direction from the first predetermined one of the sections to the second predetermined one of the sections is to be confirmed, ends of yarn of each of the cops are found in a yarn end feeding portion of the winder, the yarn of the cops is unwound from the cops in a plurality of winding-units of the winder, remaining yarn on any of the unwound cops is detected in a remaining yarn sensing portion of the winder, and yarnless cops are finally discharged from the winder, the improvements comprising:

sensing means comprising sensors for detecting only the presence of any one of the cops at respective sensor positions along the predetermined conveyance path, the sensor positions being by the connections of the predetermined ones of the sections of the predetermined conveyance path and the first and second predetermined ones of the sections where movement of the cops in the direction from the first predetermined one of the sections to the second predetermined one of the sections is to be confirmed; and data means responsive to the detecting of the presence by the sensors for obtaining the position data of each of the cops along the predetermined conveyance path.

2. The system as claimed in claim 1, wherein a first of the connections of the predetermined ones of the sections of the predetermined conveyance path diverges from a first one of the sections into a first two of the sections at a first diverging point where the cops are selectively carried in the direction from the first one of the sections to one of the first two sections and a second of the connections of the predetermined ones of the sections of the predetermined conveyance path converges from a second two of the sections to a second one of the sections at a second diverging point, wherein first and second ones of the sensors are at predetermined positions along the first two sections after the first diverging point in the direction, third and fourth ones of the sensors are at predetermined positions along the second two sections prior to the second diverging point in the direction, and a fifth sensor is along the second of the predetermined ones of the sections where movement of the cops in the direction from the first predetermined one of the sections to the second predetermined one of the sections, and wherein the data means obtains the position data of the cops when the cops are sensed by the first–fifth sensors.

3. The system as claimed in claim 1, wherein the predetermined conveyance path is divided into a section A where the cops are introduced, a section B where the ends of yarn are found, a section C where the ends of yarn are fed, a section D where the ends of yarn are re-found, sections E1–E30 where the cops are conveyed to the respective winding units, a section F where the cops are fed back for reentrance after the failure of entrance to the respective winding units, sections G1–G30 where the cops are entered by the winding units, the respective winding unit sections, sections H1–H30 where the cops are discharged from the winding units, sections I1–I30 where the cops are carried to be discharged between the respective winding units, a section L where the cops having remaining yarn are fed back, and a section K for discharging cops from the winder.

4. The system as claimed in claim 3, wherein said data means accumulates the number of times of missing the end of yarn and the number of times of remaining yarn when a specific cop goes into said sections D and L.

5. The system as claimed in claim 1, and further comprising an error sensor on one of the sections of the predetermined conveyance path, wherein the data means is further responsive to the error sensor for obtaining the position data of the cops.

6. In a method for tracing cops without using any special recognition material thereon by sensors on sections of conveyance on a winder wherein as many cops as spindles sequentially carried from a spinning machine are discharged, said winder comprising, along said sections of conveyance, a yarn end feeding portion for finding the end of yarn of the cops, a plurality of winding units for winding the yarn of cops around a cone, and a remaining yarn sensing portion for detecting whether there is yarn remaining, said method forming the connection state of spinning and winding, the improvements of said method comprising the steps of:

(a) scanning sensing signals of said sensors, allocating cop numbers to said cops entering said sections of conveyance, and registering the numbers to an initial entrance section of said sections of conveyance;

(b) scanning said sensing signals, and transfer-registering said cop numbers to a following position if a specific cop is determined to enter one of said sections from another; and (c) scanning said sensing signals, and erasing a corresponding cop number if a specific cop is determined to be discharged from said sections of conveyance, wherein said sensors are presence only sensors and said sensing signals are of cop presence only.

7. The method as claimed in claim 6, after said steps (a), (b) and (c), further comprising the step of storing information input from said yarn end feeding portion, winding unit, and remaining yarn sensing portion in connection with said cop numbers.

8. The method as claimed in claim 6, wherein said step (b) further comprises the step of incrementing and recording the number of losing the end of yarn with respect to a corresponding cop number if the current transfer-registered position of said specific cop is in a section where the cop is carried to find the end of yarn.

9. The method as claimed in claim 6, wherein said step (b) further comprises the step of incrementing and recording the number of remaining yarn with respect to a corresponding cop number if the current transfer-registered position of said specific cop is in a section where the remaining yarn is confirmed and then the cop is fed back.

* * * * *